United States Patent [19]

Held

[11] Patent Number: 4,625,194

[45] Date of Patent: Nov. 25, 1986

[54] A.C. CONTACTOR

[75] Inventor: Kurt Held, Amberg, Fed. Rep. of Germany

[73] Assignee: Siemens Aktiengesellschaft, Munich and Berlin, Fed. Rep. of Germany

[21] Appl. No.: 766,166

[22] Filed: Aug. 15, 1985

[30] Foreign Application Priority Data

Aug. 17, 1984 [DE] Fed. Rep. of Germany ..... 3430363
Feb. 20, 1985 [DE] Fed. Rep. of Germany ..... 3505881
Jun. 27, 1985 [DE] Fed. Rep. of Germany ..... 3523051

[51] Int. Cl.[4] ..... H01F 7/08

[52] U.S. Cl. ..... 335/271; 335/104; 335/105; 335/128; 335/193; 335/274; 335/277; 188/378; 188/380

[58] Field of Search ..... 335/257, 271, 277, 104, 335/105, 128, 193, 200, 281, 157, 192, 274; 267/88; 188/378, 379, 380

[56] References Cited

U.S. PATENT DOCUMENTS 1,845,494 2/1932 Funk ..... 335/104
2,339,610 1/1944 Baker ..... 335/271

FOREIGN PATENT DOCUMENTS 1261192 4/1961 France ..... 188/379

*Primary Examiner*—E. A. Goldberg
*Assistant Examiner*—Lincoln Donovan
*Attorney, Agent, or Firm*—F. W. Powers; J. L. James

[57] ABSTRACT

An a.c. contactor with an armature activated by a magnetic system, which is effectively connected to a return spring-loaded contactor onto which the movable contact component of the contact system is mounted. The contact carrier is herein fitted with an auxiliary mass and placed in effective contact with the armature by a coupling spring, wherein the auxiliary mass is movable in relationship to the contact carrier and an additional spacer bar component, with which the armature is coupled. The coupling spring supported on one end by the contact carrier, can on the other end connect to an offset end of the spacer component which is pressed against the auxiliary mass, whereby the auxiliary mass connects with a catch of a contact carrier or else is spring-loaded against the direction of motion of the contact carrier towards a stop on the contact carrier via a separate auxiliary spring. These improvements dampen and delay the recoil of the contact carrier experienced during switching of the a.c. contactor.

12 Claims, 8 Drawing Figures

A.C. CONTACTOR

BACKGROUND OF THE INVENTION

This invention relates to an electrical contactor and more particularly to an a.c. contactor with an armature activated by a magnetic system, which is in effective connection with a return spring-loaded contact carrier onto which the movable contact components of the contact system are mounted.

In an a.c. contactor of the above-specified type known from Federal Republic of Germany Gebrauchsmuster No. 8,134,374, the design cannot prevent the possibility that the contact carrier could return by internal bounce to the OFF position upon switch-on during an initial zero current of the exciter current for the magnetic system; thereby double switch commands could occur. It is the object of this invention to further increase the contact position reliability of an a.c. contactor by delaying the time it takes the contacts to recoil. It is a further object of this invention to effect this improvement without increasing the exterior size of the contractor through the selection of appropriately interacting choice of components.

SUMMARY OF THE INVENTION

Briefly stated, in accordance with one aspect of the invention, the foregoing objects are achieved by providing an a.c. contactor, which is activated by a magnetic system, with an armature effectively connected with a return and a return-spring-loaded contact carrier onto which moving contact components of a contact system are mounted having an additional mass connected to and cooperating with the return spring loaded contact carrier effectively connecting to the armature by a coupling spring to prevent a recoil return of the contact carrier.

By this arrangement of the additional mass in connection to the spring, the design dampens the recoil. In order to further optimize the recoil damping, it is preferrable if the coupling spring is stronger than the return spring. The arrangement in accordance with this design has proven particularly suitable if the armature is a hinged armature magnet.

The recoil damping is further improved in another embodiment of the invention if the additional mass is connected to the contact carrier spring-actuated via the coupling spring opposite to the start-up direction.

A simple further embodiment of the invention of the a.c. contactor is realized if the coupling spring in its "off" position is supported on the one hand by the contact carrier and on the other hand via the spacer bar to one end of the additional mass which, in turn, is connected with its second end to the contact carrier. Thereby, when pressing the spacer bar onto the armature, practically only the pretensioning force of the coupling spring becomes active on the armature. The recoil path of the contact carrier can be further reduced if the additional mass is spring-loaded by a separate additional spring opposite to the direction of motion of the contact bridge carrier against a stop at the contact bridge carrier. Initially the additional mass prevents a return to the contact carrier at zero current, and in conjunction with the additional leaf spring produces a time-delayed impact of the contact carrier on the armature without requiring significantly more space. The additional spring, in conjunction with the additional mass, produces a time lag, the advantage of which is that the dynamic holding force is substantially greater than it would be if the coupling spring were sized without any time lag after the holding force minimum. For the optimum time lag, the additional leaf spring can be sized in accordance with its function, i.e., it is possible to adjust the pretensioning force and spring gradient in accordance with the potential additional mass given the volume involved so that the force requirement can be handled as long as possible so that the holding force minimum is effectively bridged. In said connection it has proven preferrable if the pretensioning force of the coupling spring is approximately ten times stronger than that of the additional spring. One preferrable design consists of having the additional spring designed as a leaf spring, with two helical springs serving as the coupling spring. The recoil in contrast to the initially described design is substantially less since the spring action of the coupling spring has practically no effect on the recoil path, but rather on the force impacting on the armature ($F_{pretensioning}+C.S$). Two relatively long springs with low C-values (stiffness constant) can be used.

The contact carrier can be designed the same for either a d.c. or a.c. drive, since the additional mass and leaf spring can be omitted for a d.c. drive.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
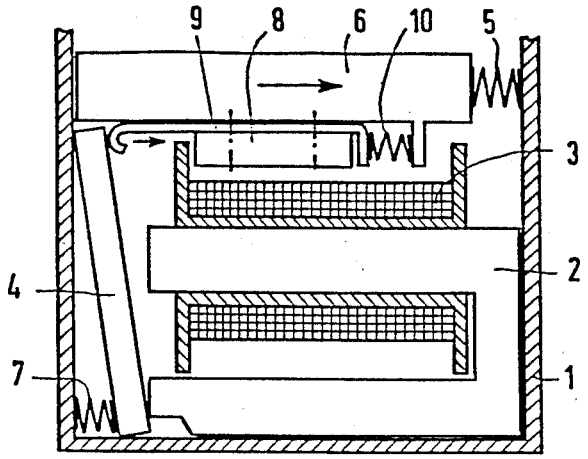
FIG. 1 depicts a diagrammatical partially cut away front view of an a.c. contactor.

The a.c. contactor shown in FIG. 1 has a housing 1 wherein are mounted a magnetic system with core 2 and coil 3 as well as armature 4, return spring 5 and return spring loaded contact carrier 6. An additional or auxiliary mass 8 is fixedly connected to the contact carrier 6 in accordance with the embodiment shown in FIGS. 1 and 2. The armature 4, designed as a hinged armature, is pressed to one pole of the core by spring 7. At the other side armature 4 is connected to component 9 which relative to the contact carrier 6 is movable and which in turn is an effective connection through coupling spring 10 to contact carrier 6.

Figure 2:
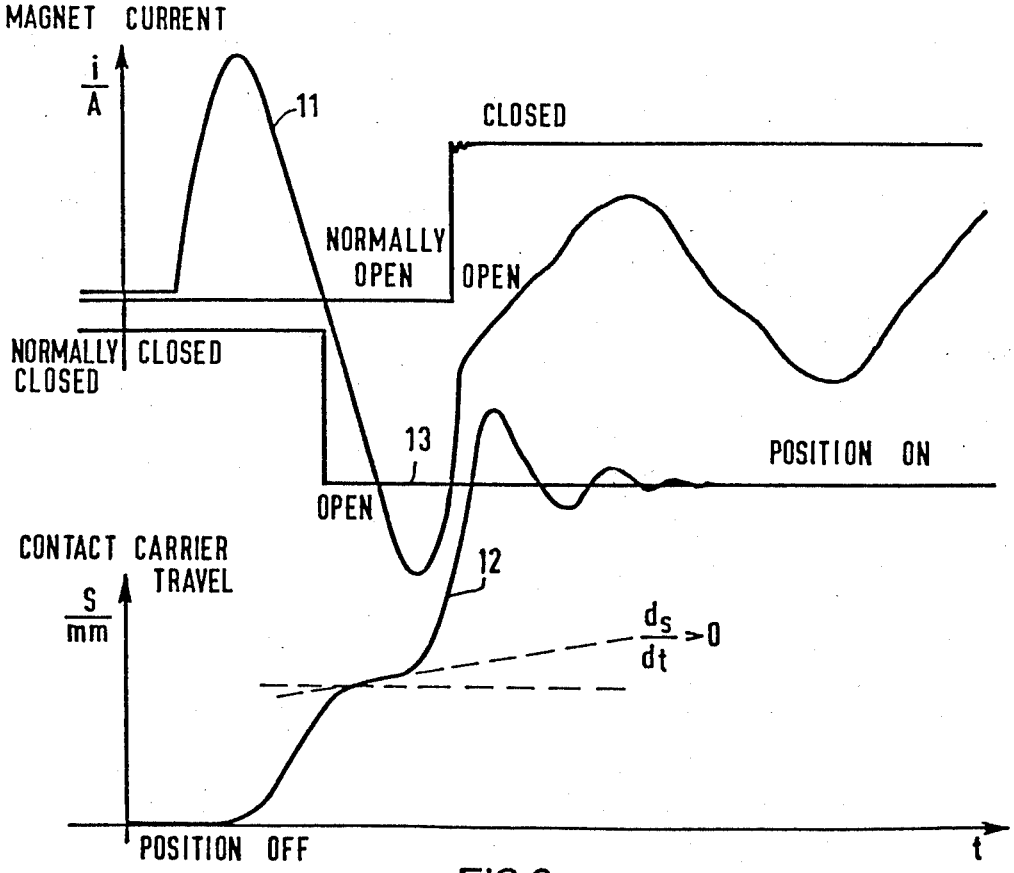
FIG. 2 illustrates the current pattern in the exciter system over time, the path of the contact carrier over time, as well as the status of an NC and an NO contact over time in accordance with FIG. 1.

Upon exciting, the magnetic system current flows in the magnetic system, as can be seen from FIG. 2. The current curve is designated 11. The armature 4 moves in the direction of core 2; the movable component 9 is placed in motion, and the pretentioned coupling spring 10 is further tensioned. As the pressure of coupling spring 10 increases, contact carrier 6 is moved against the force of return spring 5—see the graph plotting the path of the contact carrier over time with the designation 12—, whereby the not further shown normally closed (NC) contacts are opened by contact carrier 6. The opening of the contacts remains in effect, as shown in curve 13, since armature 4 is coupled to contact carrier 6 with additional mass 8 via the spring componets 10 so that the kinetic energy which up to that point had been stored prevents any recoil of contact carrier 6 when the exciter system a.c. current zeros out.

Figure 3:
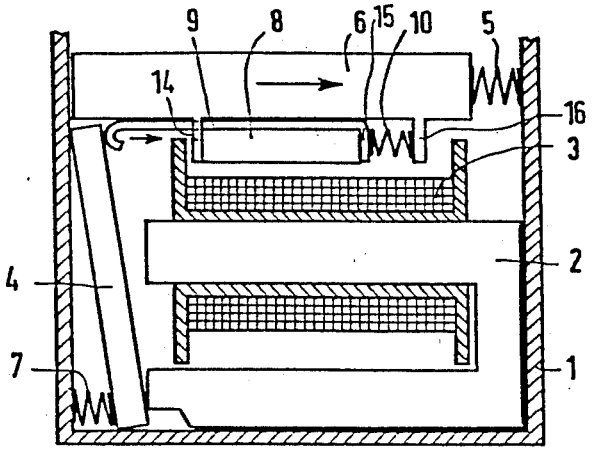
FIG. 3 depicts an improved design in a diagrammatical partially cut away front view of the a.c. contactor.
Figure 4:
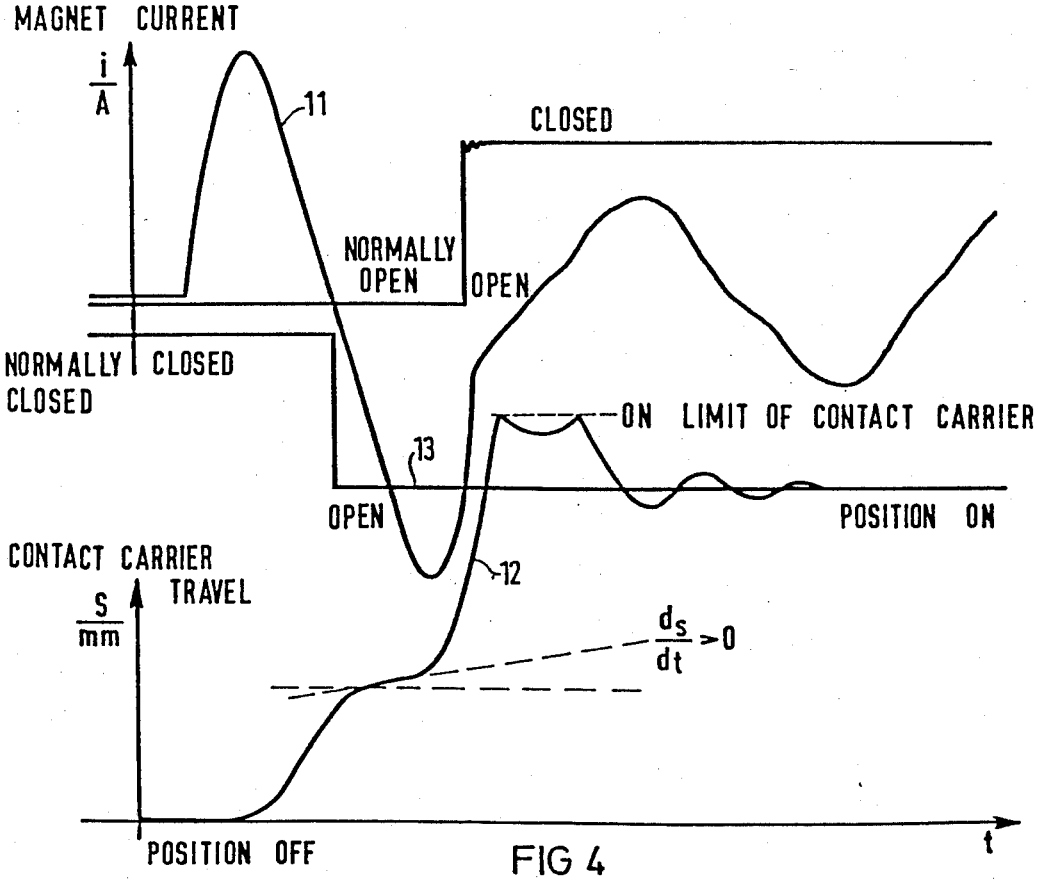
FIG. 4 illustrates the flattening of the graph depicting the path of the contact carrier over time brought about by this improvement.

In the embodiment illustrated by FIGS. 3 and 4, the additional mass 8 is connected on one side to a catch 14 of contact carrier 6. The spacer bar, which is movable in relation to contact carrier 6 and additional mass 8, is connected with its offset end 15 to the other end of the additional mass 8 and pressed towards the catch 14 by one end of spring 10 whose other end is supported by the projection 16 of contact carrier 6. This means that additional mass 8 is movable in relation to the contact carrier 6 in the "on" direction, thereby pressing together the pretensioned coupling spring 10. The coupling spring 10 here is stronger than the recoil spring 5. If the magnetic system of the embodiment shown in FIG. 3 is excited, then the same current pattern as per FIG. 2 arises in the magnetic system, as can be seen in FIG. 4. The curve is here also designated 11. The armature 4 moves in the direction of the core 2. The contact carrier 6 is put in motion by spacer bar 9 and the pretensioned coupling spring 10, and as the pressure on coupling spring 10 increases, contact carrier 6 is moved against the force of recoil spring 5. As the "on" motion increases, particularly when attaining the "on" stop of the contact carrier, the additional mass is moved in the "on" direction as the tension on coupling spring 10 increases. Thereby contact carrier 6 rests longer at the "on" stop, and due to the recoil, spacer bar 9 contacts armature 4 in a delayed fashion. This pattern can be seen from the curve in the graph showing the path of contact carrier over time, which in FIG. 4 is similarly designated 12. The recoil damping is thus substantially improved by the arrangement in accordance with FIG. 3.

Figure 5:
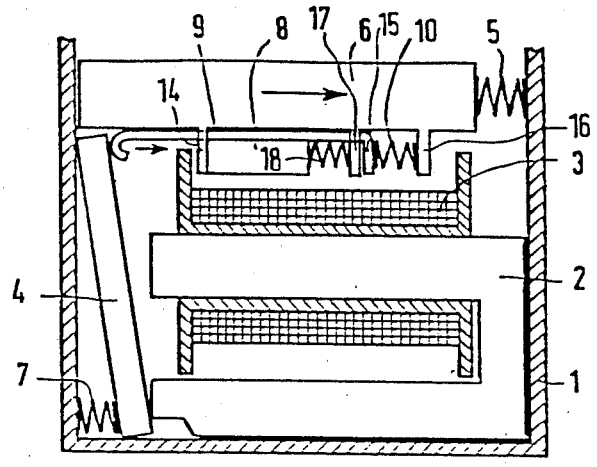
FIG. 5 depicts a diagrammatical partially cut away front view of the modified a.c. contactor improved.
Figure 6:
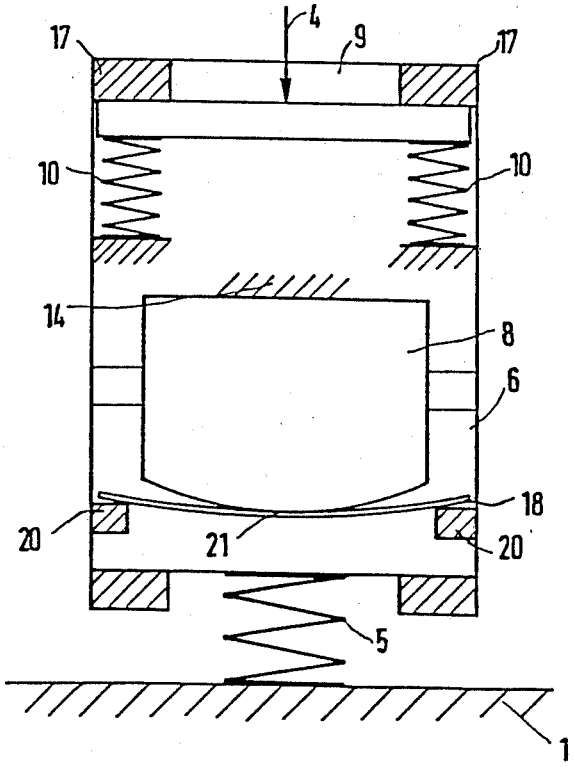
FIG. 6 depicts a partially cut away top view of an embodiment with a leaf spring as an additional spring.

In the embodiment according to FIGS. 5 and 6 the coupling spring is divided in two helical springs supported on the one end by contact carrier 6 and on the other by the movable spacer bar 9. The spacer bar 9 is pressed against stops 17 of contact carrier 6. The direction of action of armature 4 is shown in FIG. 5 by an arrow. The additional mass 8 is pressed here by an auxiliary spring leaf spring 18 against the direction of motion of contact carrier 6 in the switch-on direction towards stop 19 on contact carrier 6. The free ends of the leaf spring 18 are supported by the projections 20 of contact carrier 6. Approximately in the mid-point of leaf spring 18 the spherically shaped contact surface 21 of additional mass 8 is connected. When moving additional mass 8, leaf spring 18 envelops the spherical contact surface 21 of additional mass 8. The leaf spring in relationship to both coupling springs 10 is relatively weak in design and sized so that it can handle the contactor force requirement for a short time, i.e., provide a delay. The spacer bar 9 travels approximately 0.4 mm when contact carrier 6 with its additional mass 8 impacts against armature 4. Thus the recoil of contact carrier 6 is only approximately 0.4 mm.

Figure 7:
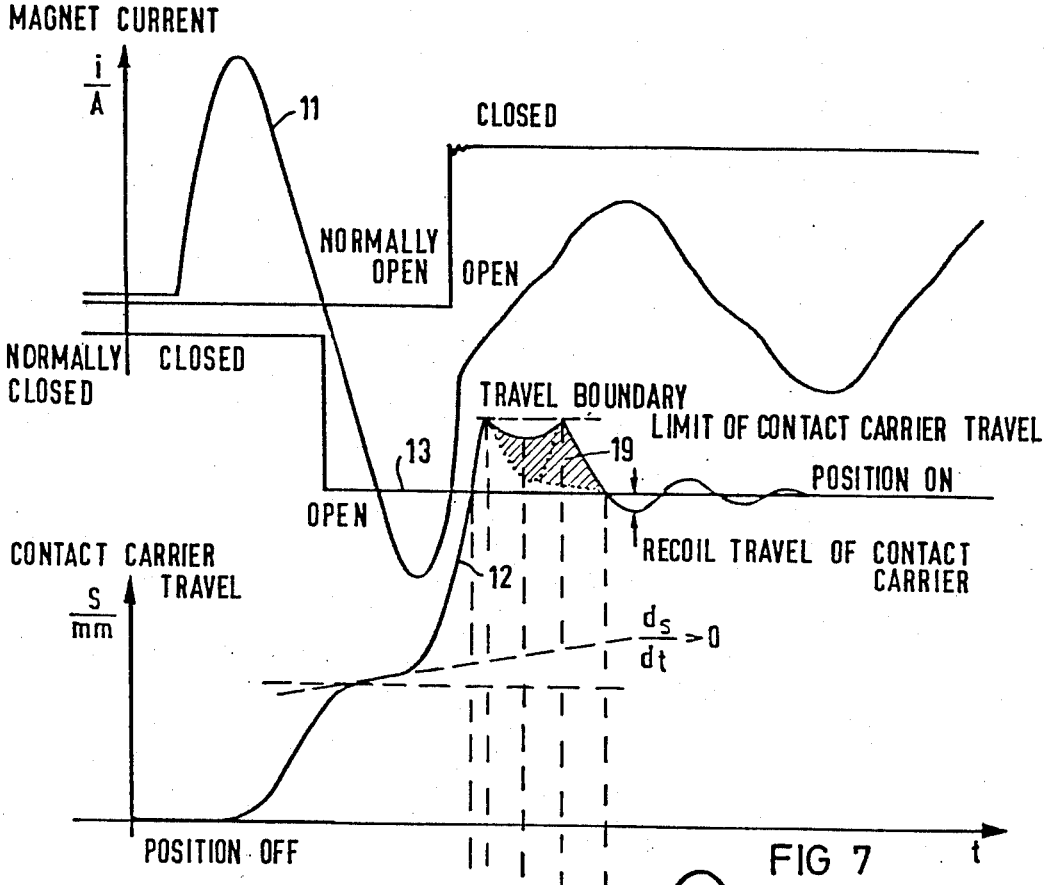
FIG. 7 illustrates the flattening of the graph depicting the path of the contact carrier over time produced by this modification.
Figure 8:
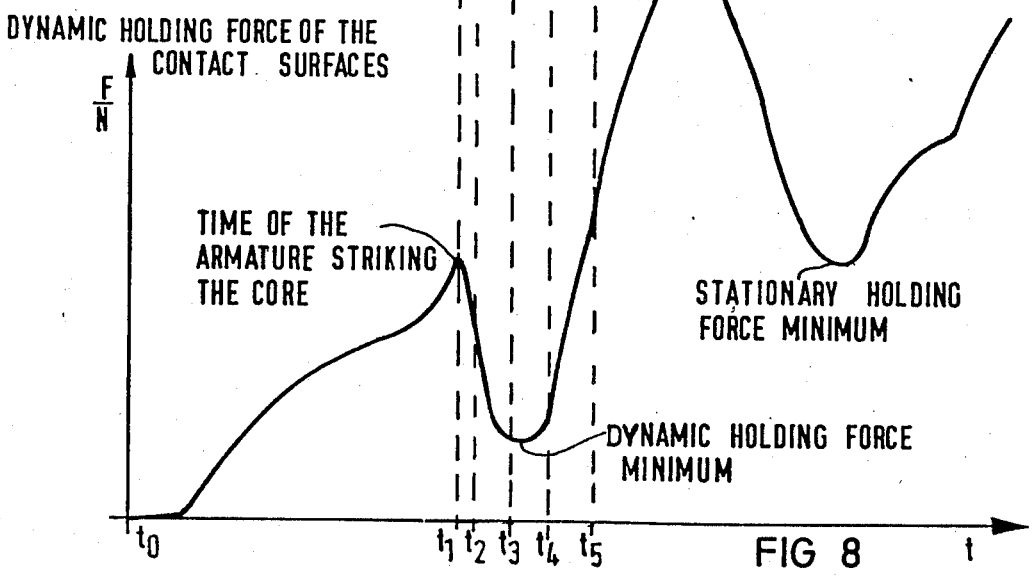
FIG. 8 illustrates the dynamic holding force of the magnetic components over time.

If the magnetic system is excited in accordance with the embodiment shown in FIG. 5, then the same current pattern in the magnetic system arises as shown in FIG. 2 as can be seen in FIG. 6. The curve is also here designated 11. In response to the exciting current, the armature moves in the direction of core 2. Contact carrier 6 is placed in motion by spacer bar 9 and the pretensioned coupling springs 10, and as the pressure on coupling springs 10 increases, the additional mass 8 along with the contact carrier is moved by catch 14. Since leaf spring 18 is weaker than the coupling springs 10, the additional mass 8, when reaching the "on" stop of contact carrier 6, travels a greater distance, i.e., the return from the spring-loaded spacer bar to the spring-loaded additional mass takes place with a time delay. This situation can be seen from the curve plotted in the graph path of contact carrier over time which is similarly designated as 12 in FIG. 6. The range of dispersion of the path/time behavior determined by the phase position is shown in broken lines in FIG. 7 and designated as 19. The dynamic holding force plotted over time in FIG. 8 refers to the contact carrier path/time graph of FIG. 7.

It will now be understood that there has been disclosed an improved anti-recoil a.c. contactor. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. An a.c. contactor including a magnetic system having an armature effectively connected with a return and a return spring loaded contact carrier onto which moving contact components of a contact system are mounted, comprising:

an auxiliary mass connected to and cooperating with the return spring loaded contact carrier effectively connecting to the armature by a coupling spring preventing a recoil return of the contact carrier.

2. An a.c. contactor according to claim 1, wherein: the coupling spring is stronger than the return spring.

3. An a.c. contactor according to claim 1, wherein the armature is a hinged armature magnet.

4. An a.c. contactor according to claim 2, wherein the armature is a hinged armature magnet.

5. An a.c. contactor according to claim 1, further comprising: a spacer bar slidably mounted directly to the contact carrier and also connected by the coupling spring to the contact carrier; and the spacer bar further connects to the armature.

6. An a.c. contactor according to claim 2, further comprising: a spacer bar slidably mounted directly to the contact carrier and also connected by the coupling spring to the contact carrier; and the spacer bar further connects to the armature.

7. An a.c. contactor including a magnetic system having an armature effectively connected with a return spring, and a return spring loaded contact carrier, onto which moving contact components of a contact system are mounted comprising:

an auxiliary mass connected to and cooperating with the return spring loaded contact carrier effectively connecting to the armature by a coupling spring, wherein the auxiliary mass is connected by the coupling spring in a spring-activated fashion to the contact carrier to a start-up direction.

8. An a.c. contactor according to claim 7, further comprising:

a spacer bar slidably mounted directly to the contact carrier and also connected by the coupling spring to the contact carrier at one end;

the spacer bar also connected to the armature at a second end;

the coupling spring in an OFF position supported on one end by the contact carrier and another end by one end of the auxiliary mass by means of the spacer bar; and a second end of the auxiliary mass is connected to the contact carrier.

9. An a.c. contactor according to claim 4, further comprising: an auxiliary spring spring-loading the auxiliary mass opposite to a direction of motion of the contact carrier towards a stop on the contact carrier.

10. An a.c. contactor according to claim 9, wherein the coupling spring is pretensioned with a force approximately ten times as strong as a force of the auxiliary spring.

11. An a.c. contactor according to claim 9, wherein:

the auxiliary spring is a leaf spring; and the coupling spring is made up of two helical springs.

12. An a.c. contactor according to claim 10, wherein:

the auxiliary spring is a leaf spring; and the coupling spring is made up of two helical springs.

* * * * *